US005169136A

United States Patent [19]

Yamagata et al.

[11] Patent Number: 5,169,136

[45] Date of Patent: Dec. 8, 1992

[54] AUTOMATIC PAPER FEEDER EMPLOYING A LOST MOTION MECHANISM

[75] Inventors: Masahiro Yamagata; Koichiro Kitazume, both of Tokyo, Japan

[73] Assignee: Daiwa Seiko, Inc., Tokyo, Japan

[21] Appl. No.: 789,009

[22] Filed: Nov. 7, 1991

[30] Foreign Application Priority Data

Nov. 8, 1990 [JP] Japan ..... 2-117484[U]

[51] Int. Cl.[5] ..... B65H 5/06

[52] U.S. Cl. ..... 271/10; 271/272; 400/636.2

[58] Field of Search ..... 271/10, 12, 267, 268, 271/272; 400/551, 636.2, 637.1, 659

[56] References Cited

U.S. PATENT DOCUMENTS 4,523,869 6/1985 Martin ..... 400/636.2
4,927,130 5/1990 Tanaka et al. ..... 271/10

FOREIGN PATENT DOCUMENTS 65306 11/1982 European Pat. Off. ..... 271/10
225037 9/1988 Japan ..... 271/10
1-83561 6/1989 Japan .

*Primary Examiner*—Robert P. Olszewski
*Assistant Examiner*—Steven M. Reiss
*Attorney, Agent, or Firm*—Longacre & White

[57] ABSTRACT

An automatic paper feeder for feeding a sheet of paper from a paper supply bin to a platen of a printer, comprises: a paper feed roller by which an outermost one of the sheets of paper stacked in the paper supply bin is fed toward the platen while being separated from the rest of sheets of paper; at least one conveyance roller provided between the platen and the paper feed roller train, the conveyance roller receiving a forward turning power from a drive shaft of the printer through a drive gear train having a gear unit; and a one-way torque transmission member provided between the gear unit and a shaft of the conveyance roller nearest to the platen, for transmitting the forward turning powr from the gear unit to the conveyance roller shaft only when the drive shaft of the printer is rotated in the forward direction, wherein a lost motion member is provided to the gear unit and the one-way torque member for preventing the forward turning power of the drive shaft from transmitting to the conveyance roller shaft until the gear unit is forwardly rotated in a predetermined angle, after transmitting the forward turning power from the drive shaft to the conveyance roller shaft and then transmitting a backward turning power from the drive shaft to the gear unit so that the gear unit is backwardly rotated in the predetermined angle.

8 Claims, 19 Drawing Sheets

AUTOMATIC PAPER FEEDER EMPLOYING A LOST MOTION MECHANISM

BACKGROUND OF THE INVENTION

The present invention relates to an automatic paper feeder, more particularly to an automatic paper feeder in which a conveyance roller is provided between a paper feed roller and the platen of a printer.

A sheet of paper, which is shorter at the edge thereof in the direction of feeding of the sheet of paper than at the other edge thereof across the direction as a slip and a horizontally slender postcard, is generally required to be 10 accurately fed from an automatic paper feeder to the platen of a printer. For that reason, an automatic paper feeder having a second conveyance roller between a paper feed roller as a first conveyance roller at a paper supply bin and the platen of a printer, has been developed as disclosed in the Japan Utility Model Application (OPI) No. 83561/89 (the term "OPI" as used herein means an "unexamined published application"). The latter automatic paper feeder is described with reference to FIGS. 16 through 24 from now on. The feeder 1 is removably attached to the printer 2. The feeder 1 includes the paper supply bin 3 in which sheets of blank paper are stacked together in a titled posture, and a paper reception bin 4 in which the sheets of printed paper are stacked together. A first paper feed roller shaft 6 is rotatably supported by the right and left side plates 5A and 5B of the body frame 5 of the feeder 1, and horizontally extends between the side plates. The body of a first paper feed roller 7, which is put in pressure contact with the outermost sheet of blank paper, is mounted on the intermediate portion of the first paper feed roller shaft 6. A clutch 8 is attached to the shaft 6 at the end thereof to transmit torque to the shaft at appropriate timing. A second paper feed roller shaft 9, which is a conveyance roller shaft, is rotatably supported by the side plates 5A and 5B, and horizontally extends between them in parallel with the first paper feed roller shaft 6. The body of a second paper feed roller 10, which is a conveyance roller, is mounted on the intermediate portion of the second paper feed roller shaft 9, located nearly in the middle of the distance between the first paper feed roller 7 and the platen 16 of the printer 2, and smaller in outside diameter than that of the first paper feed roller 7. The body of a roller 12 is mounted on a shaft 11 rotatably supported by the side plates 5A and 5B and extending between them, and is located in pressure contact with that of the second paper feed roller 10. A paper discharge roller shaft 13 is rotatably supported by the side plates 5A and 5B, and horizontally extends between them. The body of a paper discharge roller 14 is mounted on the intermediate portion of the paper discharge roller shaft 13. A roller 15 is provided in presser contact with the paper discharge roller 14.

The platen 16 of the printer 2 is secured to a rotary shaft 17 rotatably supported by the body of the printer and extending horizontally. A platen gear 18 is provided on the rotary shaft 17. Torque is transmitted from a motor 19 to the platen gear 18 through a drive gear 19A and an idle gear 20. The first paper feed roller 7 is kinematically coupled to the rotary shaft 17 through a torque transmission gear train 21 provided at the side plate 5B, and the clutch 8. The gear 22A of a bushing gear unit 22 for transmitting torque to the second o paper feed roller shaft 9 is engaged with an idle gear 21A of the gear train 21.

As shown in FIGS. 18 and 19, the bushing gear unit 22 includes the gear 22A and a cylindrical portion 22B integrated with the gear concentrically thereto and rotatably fitted in the side plate 5B of the body frame 5. The cylindrical portion 22B has an engagement notch 23 at the end of the portion. A one-way bearing 24 is provided in the cylindrical portion 22B, and includes an inner race 24A and an outer race 24B formed with a jut 24C on the peripheral surface of the outer race.

The second paper feed roller shaft 9 is pivotally fitted at one end thereof in the inner race 24A of the one-way bearing 24. The bearing 24 transmits forward turning power to the second paper feed roller shaft 9 only when the bushing gear unit 22 is rotated forward. In other words, the bearing 24 does not transmit backward turning power to the shaft 9 when the gear unit 22 is rotated backward or the outer race 24B of the bearing is rotated backward.

When a paper feed instruction is sent out from the control section of the printer 2, the motor 19 is put in action to transmit torque to the rotary shaft 17 through the drive gear 19A and the idle gear 20 to rotate the platen 16. The torque of the rotary shaft 17 is transmitted to the gear train 1 and the clutch 8 so that the cylindrical portion 22B of the bushing gear unit 22 is rotated through the idle gear 21A of the gear train and the gear 22A engaged with the idle gear. The torque of the bushing gear unit 22 being rotated synchronously with the platen 16 is transmitted to the second paper feed roller shaft 9 so that the outer race 24B of the one-way bearing 24 is rotated synchronously with the forward rotation of the bushing gear unit. Torque is not transmitted to the inner race 24A of the one-way bearing 24 when the bushing gear unit 22 is rotated backward.

If the printer 2 is a dot printer, a line printer or the like and is capable of printing characters of normal height, characters of double height, a vertical line, an exponent and so forth and the character of double height, the vertical line or the like is to be printed by the printer, the sheet of paper is first fed by a length for two horizontal lines through the use of the automatic paper feeder 1, the lower portion of the character, the vertical line or the like is then printed on the sheet of paper, the sheet of paper is thereafter moved back by a length for one horizontal line, and the upper portion of the character, the line or the like is then printed on the sheet of paper. When the sheet of paper is moved back by the length for one horizontal line after being fed by the length for two horizontal lines, the sheet of paper is loosened between the second paper feed roller 10 and the platen 16 due to the operation of the one-way bearing 24 provided concentrically to the roller. The reason for the loosening is that since the jut 24C of the one-way bearing 24 is engaged in the engagement notch 23 of the bushing gear unit 22, the second paper feed roller 10 remains stopped throughout the backward rotation of the platen 16 to result in loosening the sheet of paper and the sheet of paper is thereafter fed by the same length at the roller and the platen through the forward rotation of the platen while remaining loosened. When such printing is repeated, the loosening of the sheet of paper is cumulated to cause it to undergo bending, improper feeding or the like.

The cause of the loosening of the sheet of paper is described in detail from now on, with reference to sequential steps shown in FIGS. 20, 21, 22, 23 and 24. The upper and lower portions of each of these drawings show the positional relationship between the one-way bearing 24 and the bushing gear unit 22 and the operational relationship between the second paper feed roller 10 and the platen 16, respectively. When the platen 16 is rotated forward to feed the sheet of paper by a length for two horizontal lines in order to print a character of double height on the paper by the printer 2, after the printing of a character of normal height in a first row on the paper, for example, the bushing gear unit 22 is rotated forward synchronously with the platen so that the jut 24C of the one-way bearing 24, which is engaged in the engagement notch 23 of the bushing gear unit, is turned forward to rotate the second paper feed roller 10, as shown in FIG. 20. The lower half of the character of double height is then printed in a second row on the sheet of paper. After that, the platen 16 is rotated backward by a length for one horizontal line in order to print the upper half of the character of double height on the sheet of paper, as shown in FIG. 21. At that time, the jut 24C of the one-way bearing 24 is turned backward, torque is not transmitted through the inner and outer races 24A and 24B of the bearing, the inner race is not rotated backward synchronously with the platen 16, and the second paper feed roller shaft 9 remains stopped, so that the paper is loosened. In this step, the upper half of the character of double height is printed in the second row on the sheet of paper. When a character of double height is to be then printed in a third row on the sheet of paper by the printer 2 in the steps shown in FIGS. 22 and 23, the platen 165 is rotated forward to feed the sheet of paper by a length for three horizontal lines. For that purpose, the platen 16 is first rotated forward to rotate the second paper feed roller shaft 9 through the one-way bearing 24 to feed the sheet of paper by a length for one horizontal line to move out the lower half of the second-row character of double height from under the printing head of the printer 2 in the step shown in FIG. 22. At that time, since the sheet of paper is fed by both the platen 16 and the second paper feed roller 10, the paper remains loosened. The platen 16 is thereafter rotated forward to feed the sheet of paper by a length for two horizontal lines to print the lower half of the character of double height in the third row on the sheet of paper in the step showing FIG. 23. The platen 16 is then rotated backward to move back the sheet of paper by a length for one horizontal line to print the upper half of the character of double height in the third row on the sheet of paper in the step shown in FIG. 24, thus completing the printing of the character of double height in the third row on the sheet of paper. At that time, because of the operation of the one-way bearing 24, the second paper feed roller shaft 9 is not rotated backward but remains stopped. For that reason, the sheet of paper undergoes loosening by a length for one horizontal line in addition to the former loosening by a length for one horizontal line, so that the sheet of paper is resultantly loosened by a length for two horizontal lines. In other words, the sheet of paper is cumulatively loosened the same number of times as the moving-back thereof. This is a problem.

SUMMARY OF THE INVENTION

The present invention was made in order to solve the problem mentioned above. Accordingly, it is an object of the invention to provide an automatic paper feeder in which forward turning power is transmitted to a second paper feed roller only at the time of the forward rotation of the platen of a printer to feed a sheet of paper by a length for a prescribed number of horizontal lines to print the lower portion of a character, a vertical line or the like on the sheet of paper by the printer, and the sheet of paper is thereafter moved back by a length for a prescribed number of horizontal lines to print the upper portion of the character, the vertical line or the like, so that the sheet of paper is not cumulatively loosened nor undergoes wrinkling, bending, jamming or the like.

An automatic paper feeder for feeding a sheet of paper from a paper supply bin to a platen of a printer, comprises: a paper feed roller by which an outermost one of the sheets of paper stacked in the paper supply bin is fed toward the platen while being separated from the rest of sheets of paper; at least one conveyance roller provided between the platen and the paper feed roller train, the conveyance roller receiving a forward turning power from a drive shaft of the printer through a drive gear train having a gear unit; and a one-way torque transmission member provided between the gear unit and a shaft of the conveyance roller nearest to the platen, for transmitting the forward turning power from the gear unit to the conveyance roller shaft only when the drive shaft of the printer is rotated in the forward direction, wherein a lost motion member is provided to the gear unit and the one-way torque member for preventing the forward turning power of the drive shaft from transmitting to the conveyance roller shaft until the gear unit is forwardly rotated in a predetermined angle, after transmitting the forward turning power from the drive shaft to the conveyance roller shaft and then transmitting a backward turning power from the drive shaft to the gear unit so that the gear unit is backwardly rotated in the predetermined angle.

When a character of double height, for example is printed on the sheet of paper by the printer, the lower portion of the character is printed thereon in a first step, the upper portion of the character is printed thereon in a second step, and the sheet of paper is fed in a third step without printing. In the first step, the platen is rotated forward to transmit the forward turning power to the shaft of the second paper feed roller through the drive gear train and the one-way torque transmission means to rotate the second paper feed roller. In the second step, the platen is rotated backward, and the one-way torque transmission means is not rotated backward but remains stopped, because of the operation of the lost motion part, even if the gear of the drive gear train is rotated backward by the platen, so that the backward turning power of the drive shaft of the printer is not transmitted to the second paper feed roller, the roller remains stopped, and the sheet of paper is loosened. In the third step, the platen is rotated forward to rotate the gear of the drive gear train, but the one-way torque transmission means is not rotated backward but remains stopped, because of the operation of the lost motion part, so that the forward turning power of the drive shaft is not transmitted to the second paper feed roller, the roller remains stopped, and the sheet of paper is removed of the loosening caused in the second step. Thus, although the sheet of paper is loosened at the time of the backward rotation of the platen, the platen is rotated forward and the second paper feed roller remains stopped because of the operation of the lost motion part, after the backward rotation of the platen, to remove the loosening from the sheet of paper. In other words, the sheet of paper is not cumulatively loosened, no matter what number of times the platen is rotated backward to print characters of double height, a vertical line, exponents or the like on the sheet of paper at the full length thereof. For that reason, the sheet of paper does not undergo wrinkling, bending, jamming or the like, and is properly fed by the automatic paper feeder.

DETAILED DESCRIPTION OF EXEMPLARY EMBODIMENTS

Figure 1:
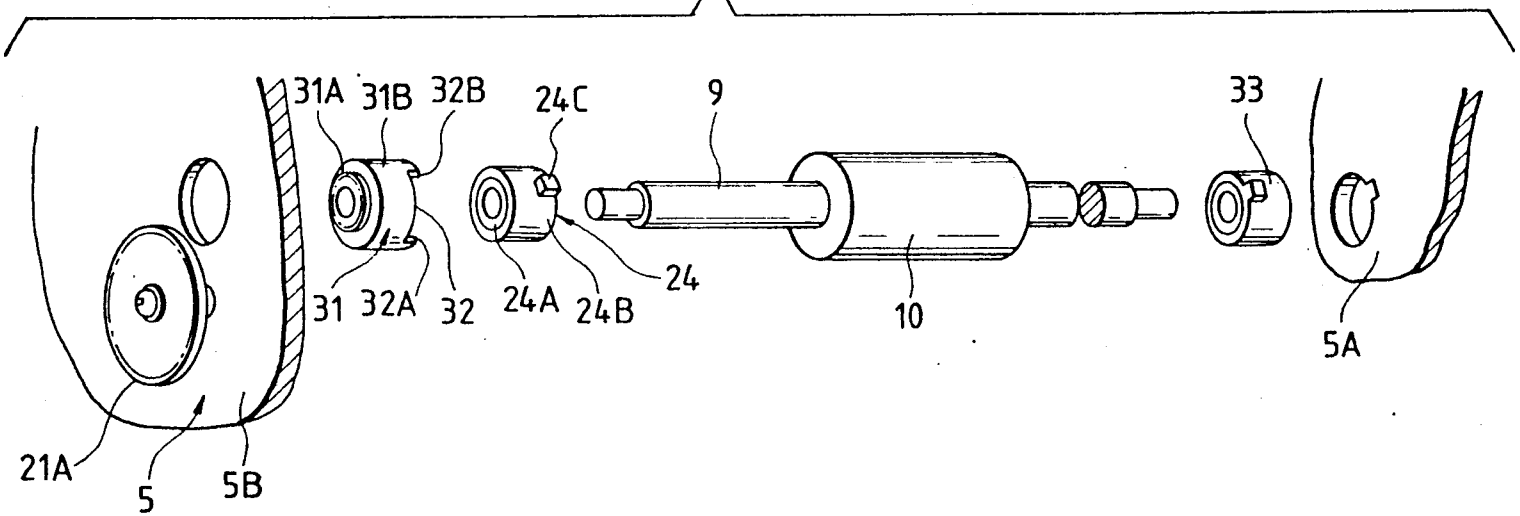
FIG. 1 is a perspective exploded view of a major part of an automatic paper feeder which is an embodiment of the present invention.
Figure 2:
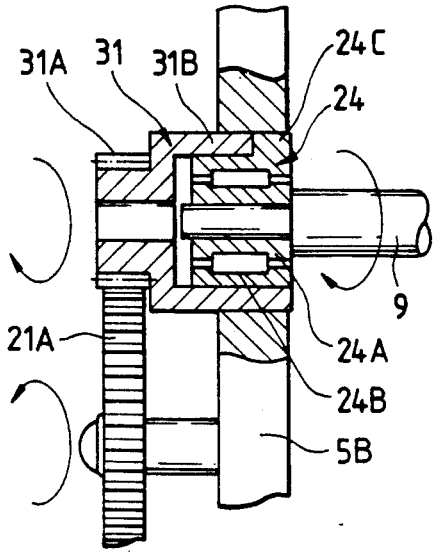
FIG. 2 is a sectional view of a major part of the feeder.
Figure 3:
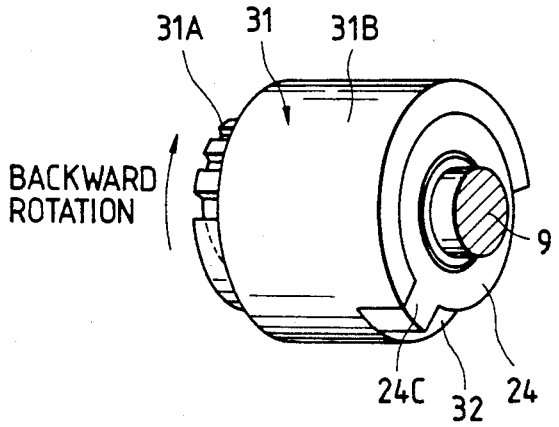
FIGS. 3 and 4 are views to illustrate the operation of the bushing gear unit and one-way bearing of the feeder.
Figure 4:
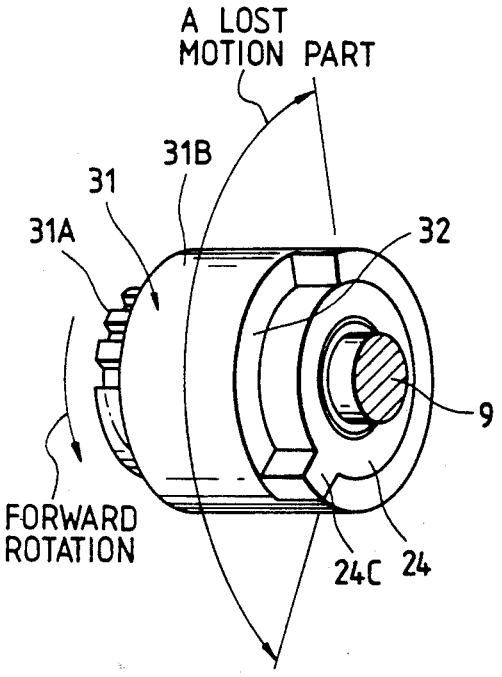
Figure 5:
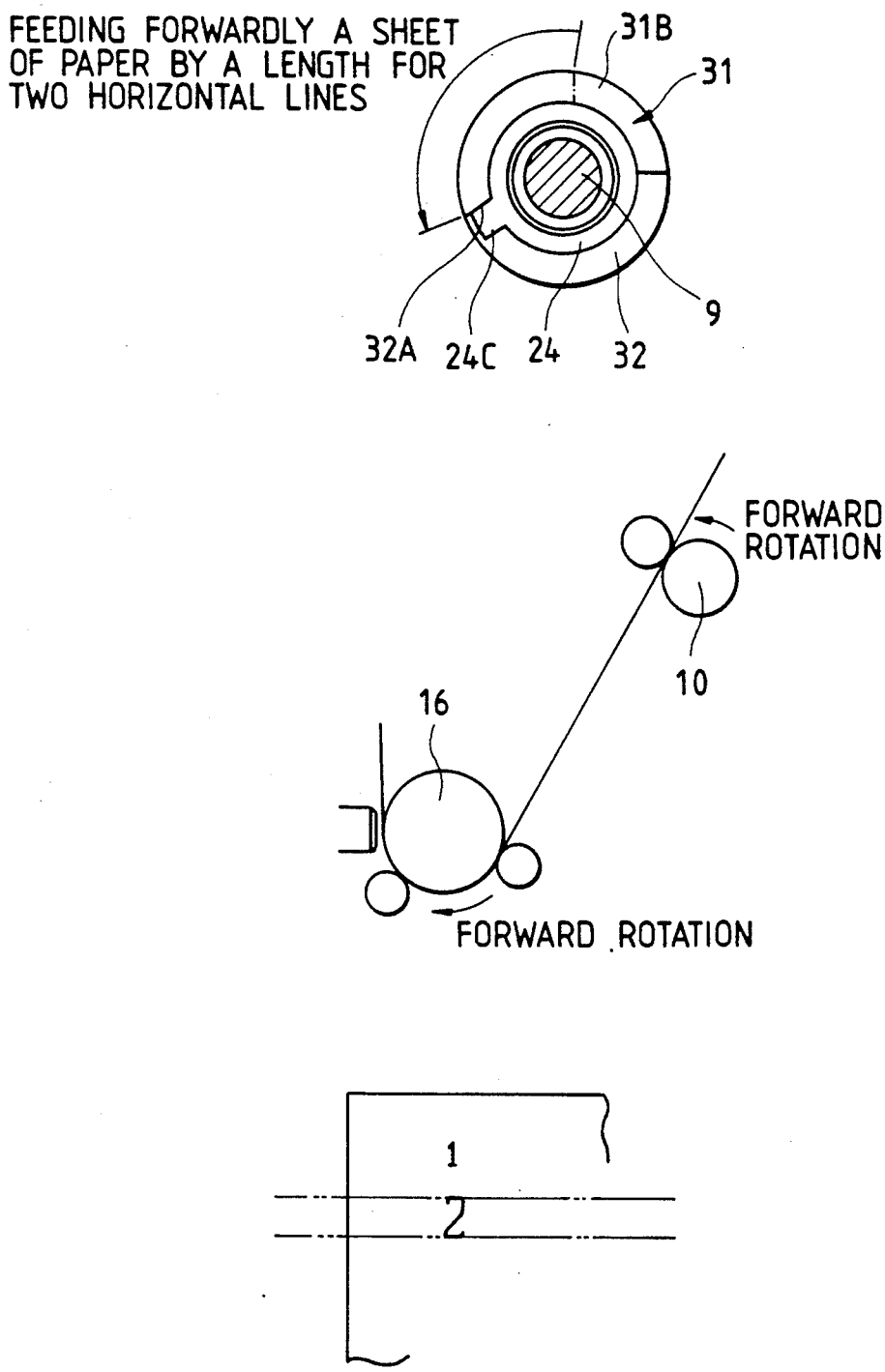
FIGS. 5, 6, 7, 8 and 9 are views to illustrate the operation of the feeder.
Figure 6:
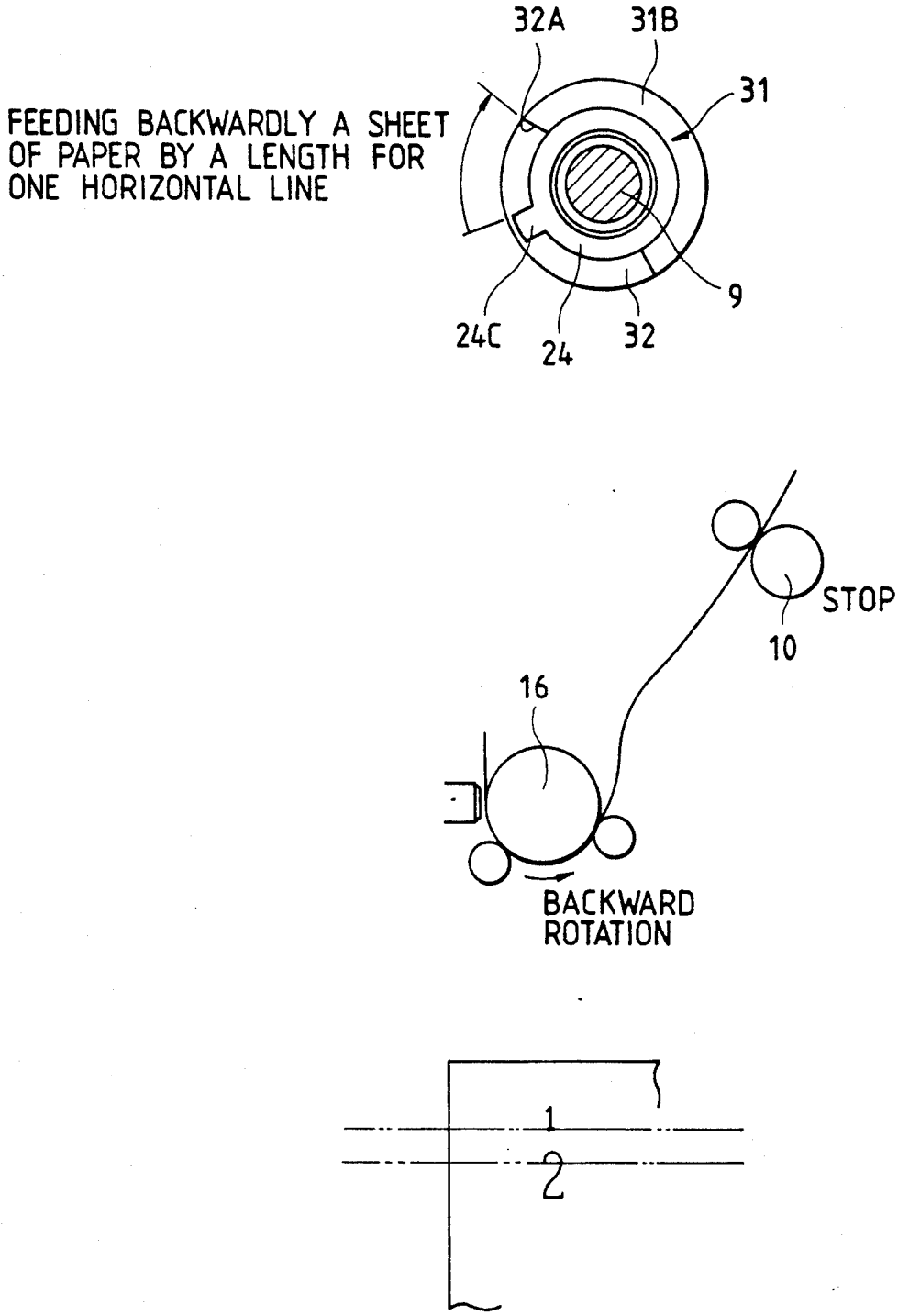

Embodiments of the present invention are hereafter described in detail with reference to the drawings attached hereto.

FIGS. 1 through 9 show an automatic paper feeder which is one of the embodiments. Since the feeder is similar to the conventional automatic paper feeder described above, the part of the former, which differs from the latter, is described in the main from now on. The mutually equivalent portions of the feeders are denoted by the same reference symbols herein. Shown at 31 in FIGS. 1, 2, 3 and 4 is the bushing gear unit of the feeder. The bushing gear unit 31 includes a gear 31A engaged with an idle gear 21A, and a cylindrical portion 31B integrated with the gear concentrically thereto and rotatably fitted in one side plate 5B of the body frame 5 of the feeder. The cylindrical portion 31B has a notch 32 at the end of the portion in such a manner that the notch extends with a prescribed central angle and constitutes a lost motion part. A one-way bearing 24 is provided in the cylindrical portion 31B, and includes an inner race 24A and an outer race 24B formed with a jut 24C on the peripheral surface of the outer race so that the jut can be moved in the notch 32. A second paper feed roller shaft 9 is pivotally fitted at one end thereof in the inner race 24A, and supported at the other end thereof with a one-way bearing 33 in the other side plate 5A of the body frame 5. The one-way bearing 24 transmits forward turning power to the second paper feed roller shaft 9 only when the bushing gear unit 31 is rotated forward. In other words, the bearing 24 does not transmit backward turning power to the shaft 9 when the gear unit 31 is rotated backward.

The operation of the automatic paper feeder is described from now on, with reference to sequential steps shown in FIGS. 5, 6, 7, 8 and 9. The upper, middle and lower portions of each of these drawings show the positional relationship between the one-way bearing 24 and the bushing gear unit 31, the relationship between the rotation of the second paper feed roller of the feeder and that of the platen 16 of a printer, and the state of printing by the printer, respectively. When the feeder feeds a sheet of a paper by a length for two horizontal lines in the step shown in FIG. 5, after the printing of a character "1" of normal height in a first row (in a first horizontal line) on the sheet of paper, in order to print a character "2" of double height in a second row (in a second and a third horizontal lines) on the sheet of paper, the bushing gear unit 31 is rotated forward synchronously with the forward rotation of the platen 16 so that the jut 24C of the one-way bearing 24, which is being pushed onto the edge 32A of the bushing gear unit at the notch 32 thereof, is turned forward to rotate the second paper feed roller shaft 9 forward. As a result, the jut 24C and the bushing gear unit 31 are put in positions shown in FIG. 5. In this step, the lower half of the character "2" of double height is printed in the third horizontal line on the sheet of paper by the printer. In the next step shown in FIG. 6, the platen 16 is rotated backward by a length for one horizontal line to move back the sheet of paper, and the upper half of the character "2" of double height is then printed in the second horizontal line on the sheet of paper by the printer. At that time, the bushing gear unit 31 is rotated backward synchronously with the platen 16, and the jut 24C of the one-way bearing 24 does not receive torque from the edge 32A of the bushing gear unit at the notch 32 thereof but is left in the same position as the step shown in FIG. 5, so that a gap for one horizontal line is made between the jut and the edge. At the same time, the second paper feed roller shaft 9 remains stopped, the second paper feed roller 10 is not rotated backward nor forward, and the sheet of paper is moved back by a length for one horizontal line, only at the platen 6, so that the paper is loosened by the length for one horizontal line, at the platen. The upper half of the character "2" is thus printed in the second horizontal line on the sheet of paper so that the printing of the character is completed.

Figure 7:
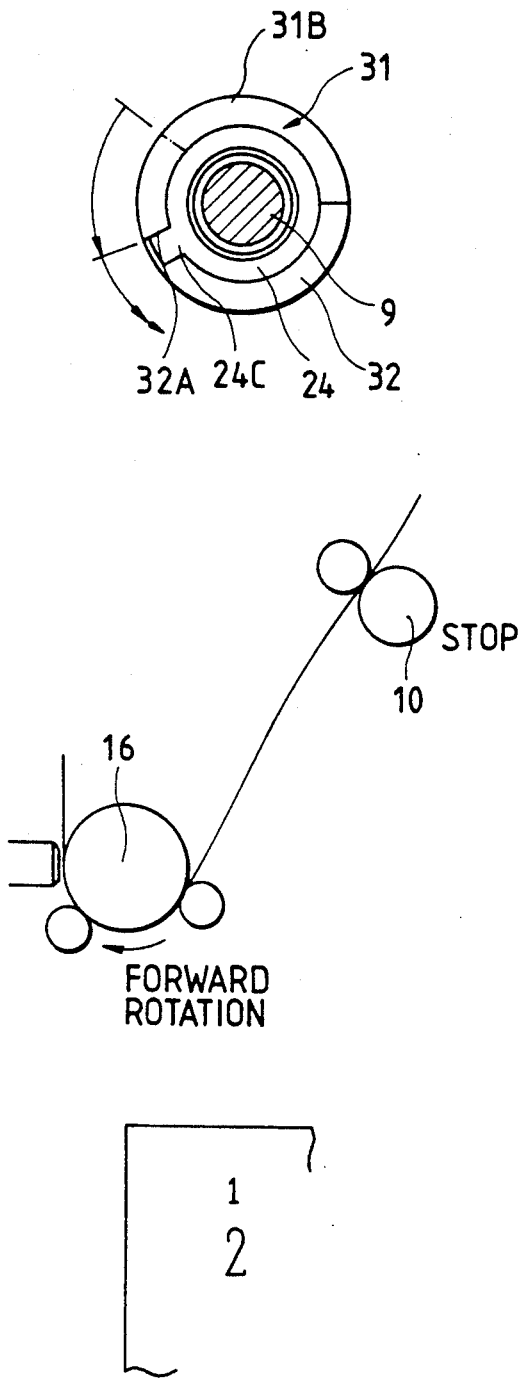
Figure 8:
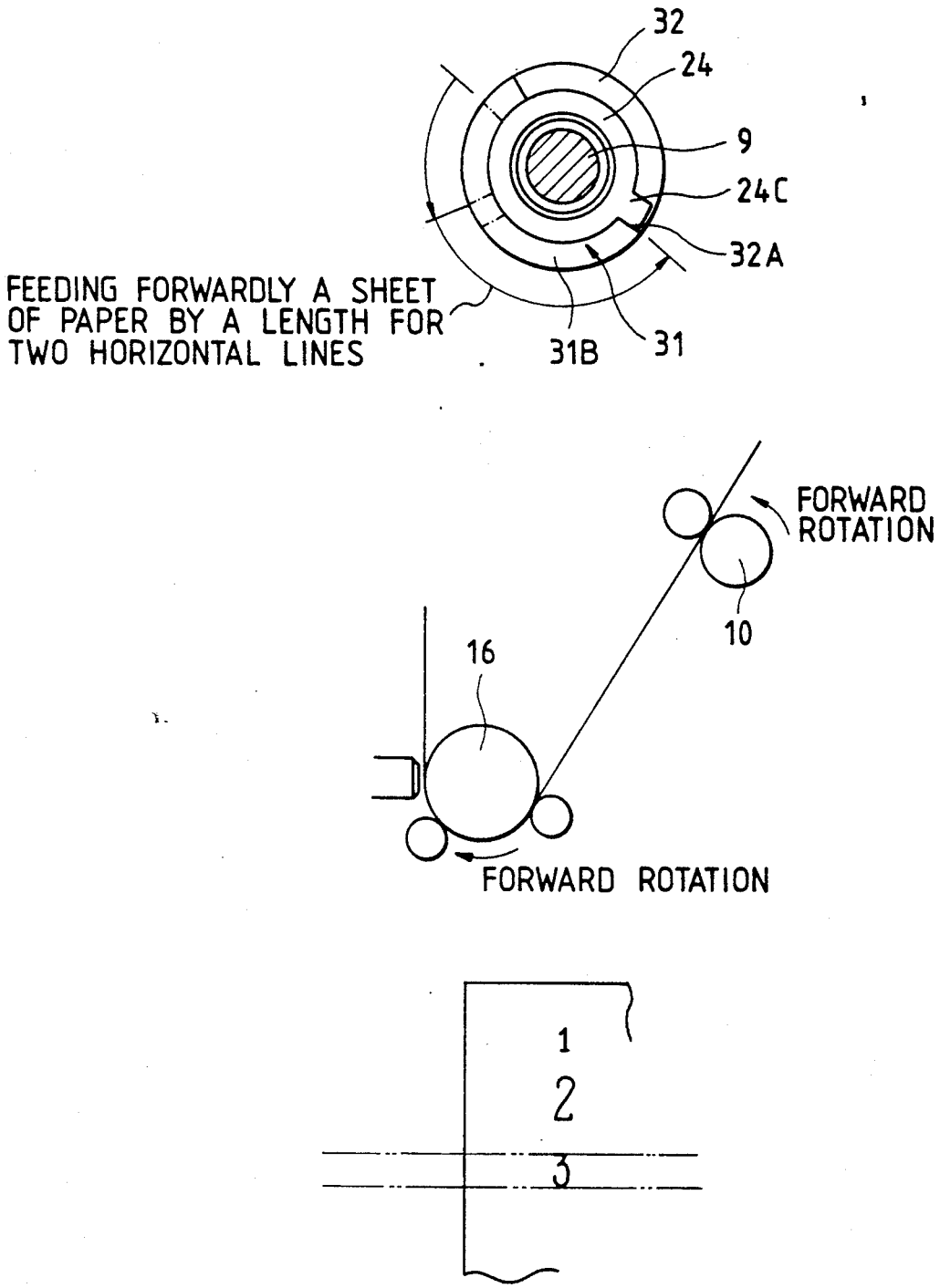
Figure 9:
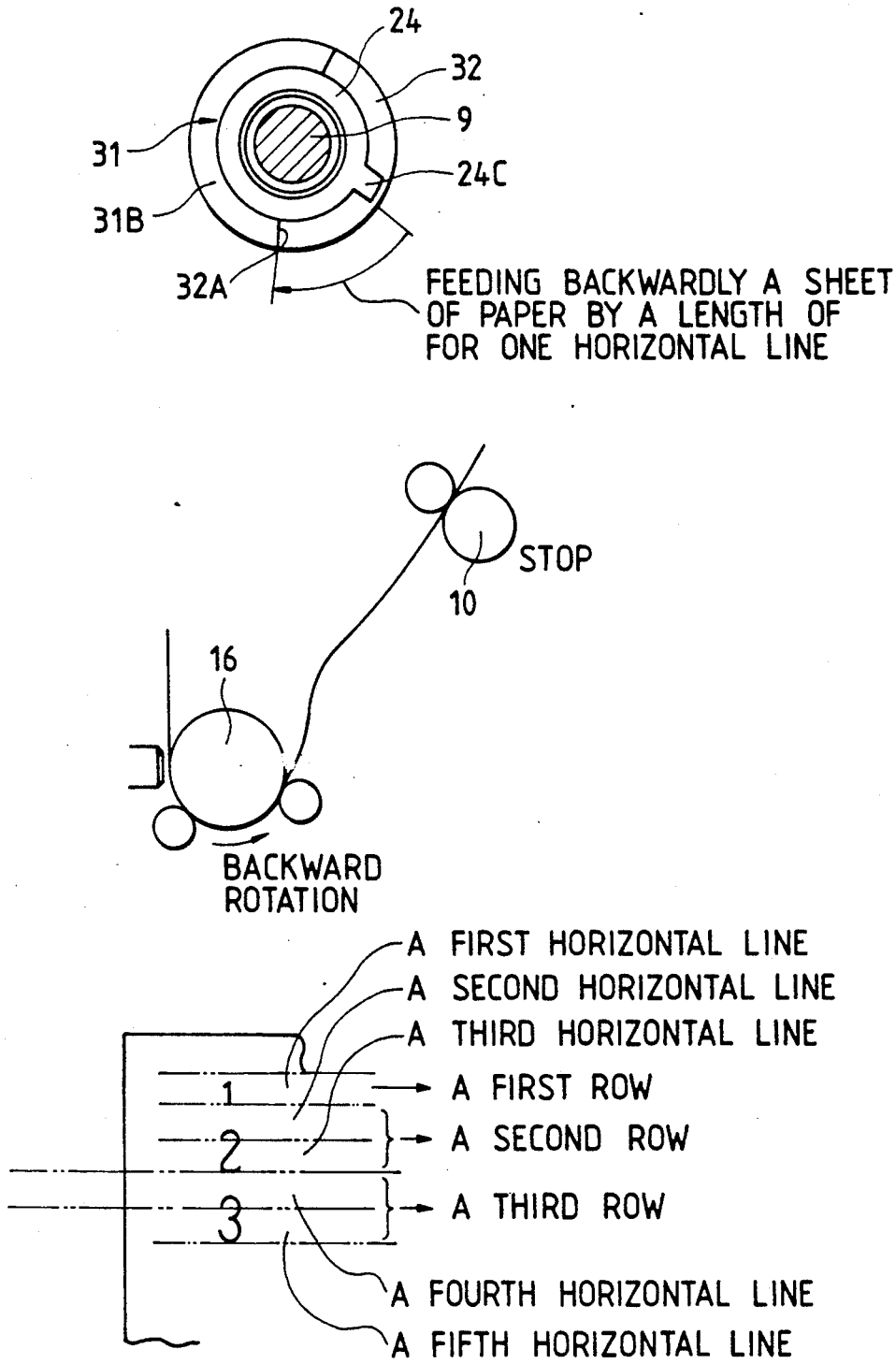

In the step shown in FIG. 7, the platen 16 and the bushing gear unit 31 are rotated forward synchronously with each other by a length for one horizontal line, the edge 32A of the unit at the notch 32 thereof comes into contact with the jut 24C of the one-way bearing 24, and the bearing does not receive torque from the unit, is not rotated forward but remains stopped. For that reason, the second paper feed roller shaft 9 is not rotated forward, but the platen 6 feeds the sheet of paper by a length for one horizontal line so that the sheet of paper is removed of the loosening caused in the preceding step shown in FIG. 6. In the next step shown in FIG. 8, the platen 16 is rotated forward further by a length for two horizontal lines, the bushing gear unit 31 is rotated forward synchronously with the platen, the jut 24C of the one-way bearing 24, which is being pushed onto the edge 32A of the unit at the notch 32 thereof, is rotated forward to a position shown in FIG. 8, the second paper feed roller shaft 9 is rotated forward by a length for two horizontal lines, and the lower half of another character "3" of double height is then printed in a fifth horizontal line (in a third row) on the sheet of paper by the printer. At that time, the sheet of per removed of the loosening in the preceding step is fed by the second paper is not loosened again. In the next step shown in FIG. 8, the platen 16 is rotated backward by a length for one horizontal line, and the upper half of the character "3" of double height is then printed in a fourth horizontal line (in the third row) on the sheet of paper by the printer. At that time, the bushing gear unit 31 is rotated backward by a length for one horizontal line synchronously with the platen 16, and the jut 24C of the one-way bearing 24 does not receive torque from the edge 32A of the unit at the notch 32 thereof and is left in the same position as the preceding step shown in FIG. 8, so that a gap for one horizontal line is made between the jut and the edge. For that reason, the second paper feed roller shaft 9 remains stopped, the second paper feed roller 10 is not rotated backward nor forward, and the sheet of paper is moved back by a length for one horizontal line, only at the platen 16, so that the sheet of paper is loosened by the length for one horizontal line. The upper half of the character "3" of double height is thus printed on the sheet of paper by the printer so that the printing of the character in the third row on the sheet of paper is completed.

In such a manner, the bushing gear unit 31 is rotated forward to remove the sheet of paper of the loosening thereof and the second paper feed roller 10 is then rotated forward, if a character is to be printed in a next row on the sheet of paper. For that reason, the sheet of paper is not cumulatively loosened even if it is moved back any number of times.

The length of the loosening of the sheet of paper, which results from the backward rotation of the platen 16, can be determined by the central angle between the edges 32A and 32B (shown in FIG. 1) of the bushing gear unit 31 at the notch 32 thereof.

In the automatic paper feeder, the notch 32 for not transmitting either of the forward turning power and backward turning power of the platen 16 to the second paper feed roller shaft 9 after rotating the platen forward to transmit the forward turning power thereof to the shaft is provided in the bushing gear unit 31 in such a manner that the length of the notch is shorter than the total circumference of the cylindrical portion 31B of the unit. For that reason, although the sheet of paper is loosened at the time of the backward rotation of the platen 16, the loosening can be removed from the sheet of paper only by rotating the platen forward after the backward rotation thereof while keeping the second paper feed roller 10 stopped through the operation of the notch 32. Therefore, the sheet of paper is not cumulatively loosened, no matter what number of times the platen 16 is rotted backward. In other words, the sheet of paper is not cumulatively loosened even if a vertical line, exponents or the like is printed on the sheet of paper at the full length thereof by the printer through the use of the automatic paper feeder. As a result, the sheet of paper does not undergo wrinkling, bending, jamming or the like, but is properly fed.

Figure 10:
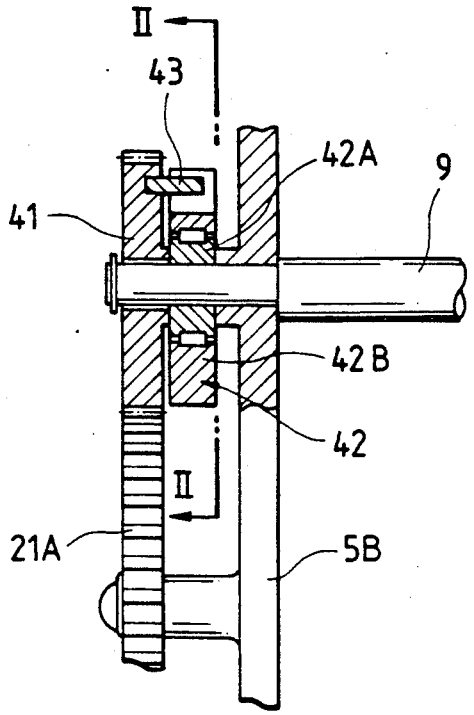
FIG. 10 is a section view of a major part of an automatic paper feeder which is another embodiment of the present invention.
Figure 11:
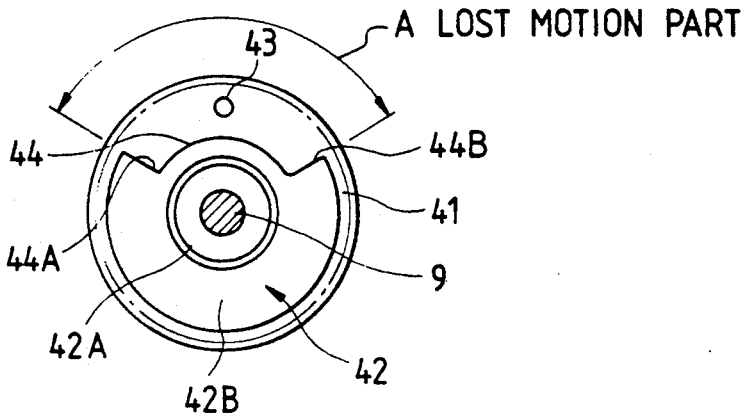
FIG. 11 is a sectional view of the part along lines II shown in FIG. 10.

FIGS. 10 and 11 show an automatic paper feeder which is another of the embodiments. The difference of the feeder from the preceding one is described in the main from now on. The mutually equivalent portions of the feeders are denoted by the same reference symbols herein. A gear 41 is movably fitted on a second paper feed roller shaft 9 at the end thereof, at which the shaft is supported by on side plate 5B of the body frame of the feeder. The gear 41 is engaged with an idle gear 21A. A one-way bearing 42 is provided between the gear 41 and the side plate 5B in such a manner that the second paper feed roller shaft 9 is fitted in the inner race 42A of the baring. A pin 43 is planted in the gear 41. The outer race 42B of the bearing 42 has a notch 44 which constitutes a lost motion part. The pin 43 is located in the notch 44.

When the platen of a printer is rotated forward, the gear 41 receives torque from the platen through the idle gear 21A so that the former gear is rotated forward, the pin 43 is turned forward into contact with the edge 44A of the one-way bearing 42 at the notch 44 thereof to rotate the outer race 42B of the bearing forward to rotate the inner race 42A thereof forward to revolve the second paper feed roller shaft 9 forward. When the gear 41 is then rotated backward by a prescribed length within the range of the notch 44 from the edge 44A of the bearing 42 to the other edge 44B thereof, the bearing is not rotated backward but remains stopped, so that a sheet of paper is loosened. When the gear 41 is thereafter rotated forward by the forward rotation of the platen 16, the one-way bearing 42 is not rotated forward until the pin 43 comes into contact with the edge 44A of the bearing at the notch 44 thereof as result of the backward turning of the pin, so that the bearing is not rotated forward. Consequently, the sheet of paper is removed of the loosening caused by the backward rotation of the platen 16. The automatic paper feeder thus produces the same effect as the preceding one does.

Figure 12:
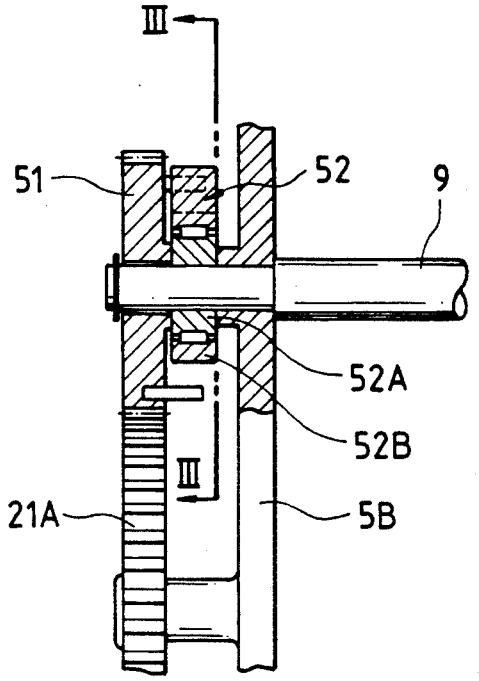
FIG. 12 is a sectional view of a major part of an automatic paper feeder which is yet another embodiment of the present invention.
Figure 13:
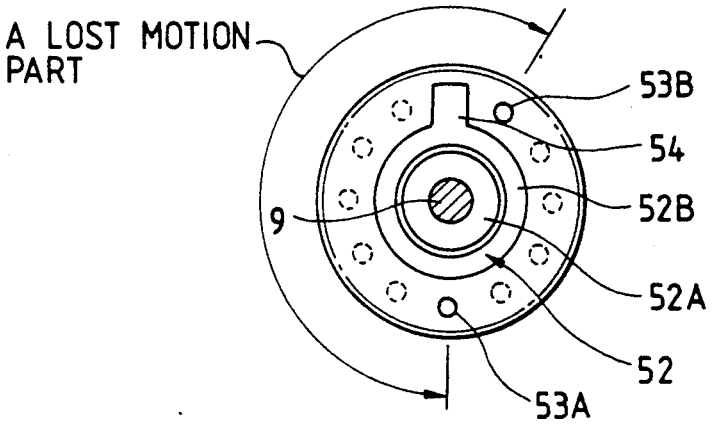
FIG. 13 is a sectional view of the part along lines III shown in FIG. 12.

FIGS. 12 and 13 show an automatic paper feeder which is yet another of the embodiments. The difference of the feeder from that shown in FIGS. 1 through 9 is described in the main from now on. The mutually equivalent portions of the feeders are denoted by the same reference symbols herein. A gear 51 is movably fitted on a second paper feed roller shaft 9 at the end thereof, at which the shaft is supported by one side plate 5B of the body frame of the feeder. The gear 51 is engaged with an idle gear 21A. A one-way bearing 52 is provided between the gear 51 and the side plate 5B in such a manner that the shaft 9 is fitted in the inner race 52A of the bearing. A pair of pins 53A and 53B are planted in the gear 51. The pins 53A and 53B correspond to the edge 44A and 44B of the one-way bearing 42 at the notch 44 thereof in the preceding feeder, respectively. The outer race 52B of a one-way bearing 52 has a jut 54, which is moved back and forth between the pins 53A and 53B so that the space for the movement of the jut constitutes a lost motion part for not transmitting either of forward turning power and backward turning power to the inner race 52A of the one-way bearing. The gear 51 may have a large number of holes at prescribed intervals in the circumferential direction of the gear so that the pins 53A and 53B are planted in selected ones of the holes to alter the space between the pins, at which the one-way bearing 52 is not rotated backward nor forward. The feeder thus performs the same operation as the preceding one, and therefore produces the same effect as the first described embodiment.

Figure 14:
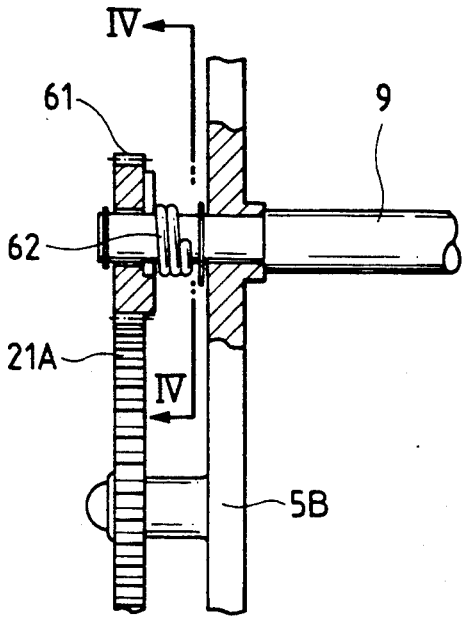
FIG. 14 is a sectional view of a major part of an automatic paper feeder which is yet another embodiment of the present invention.
Figure 15:
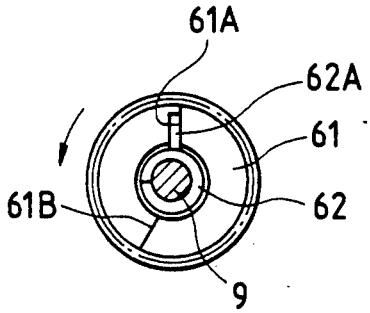
FIG. 15 is a sectional view of the part along lines IV shown in FIG. 14.
Figure 16:
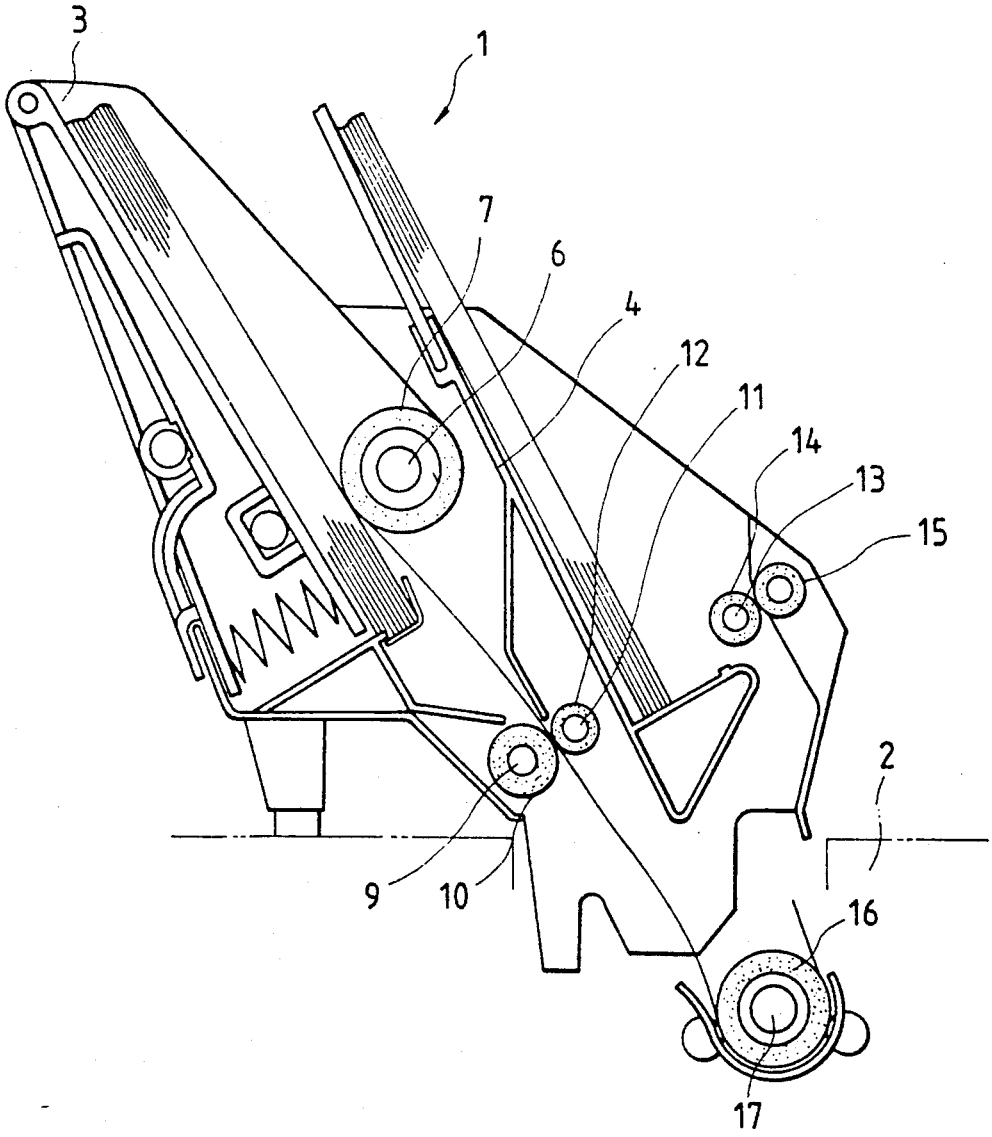
FIG. 16 PRIOR ART
FIG. 16 is a sectional view of a conventional automatic paper feeder.
Figure 17:
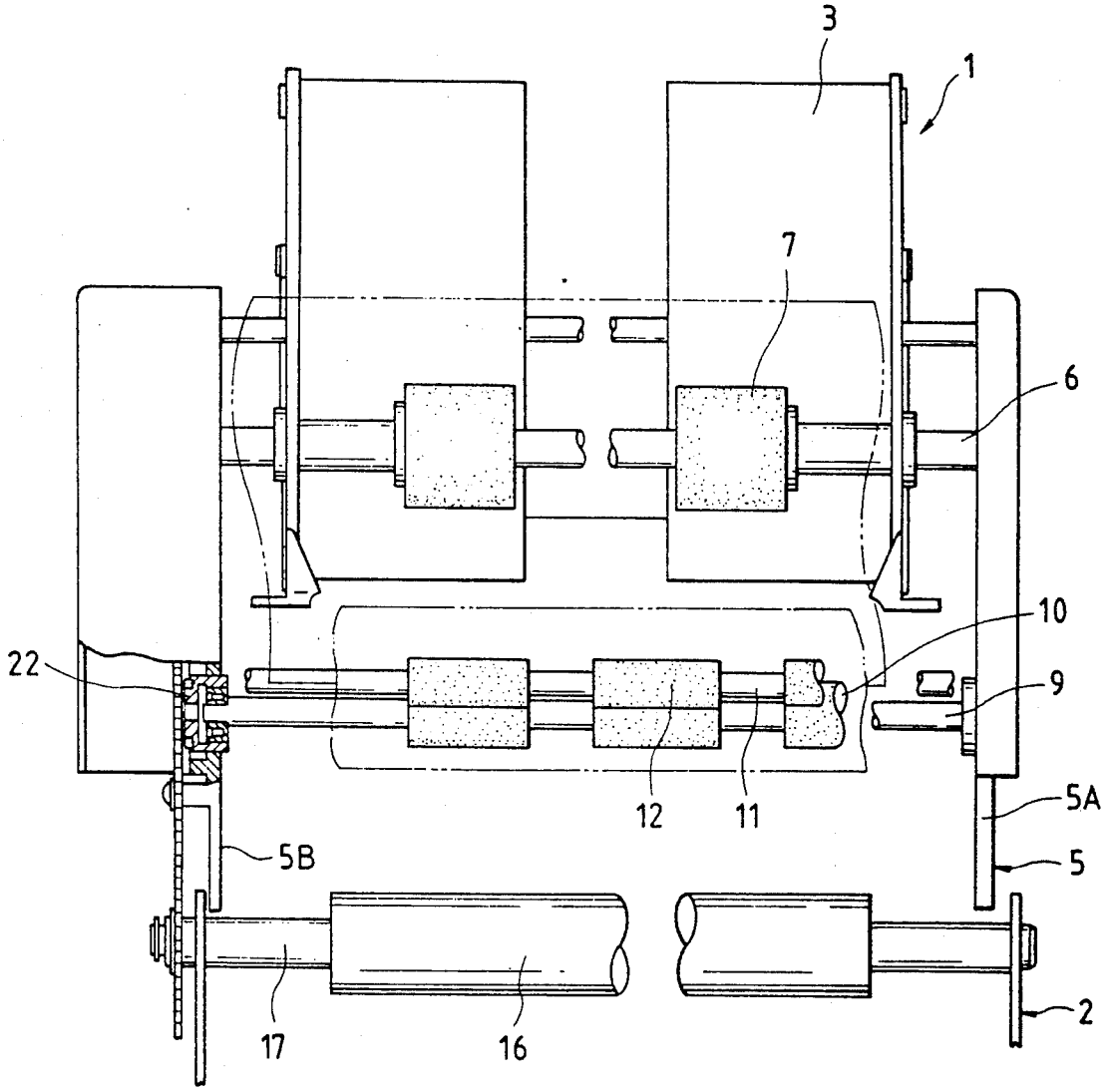
FIG. 17 PRIOR ART
FIG. 17 is a front view of the conventional feeder.
Figure 18:
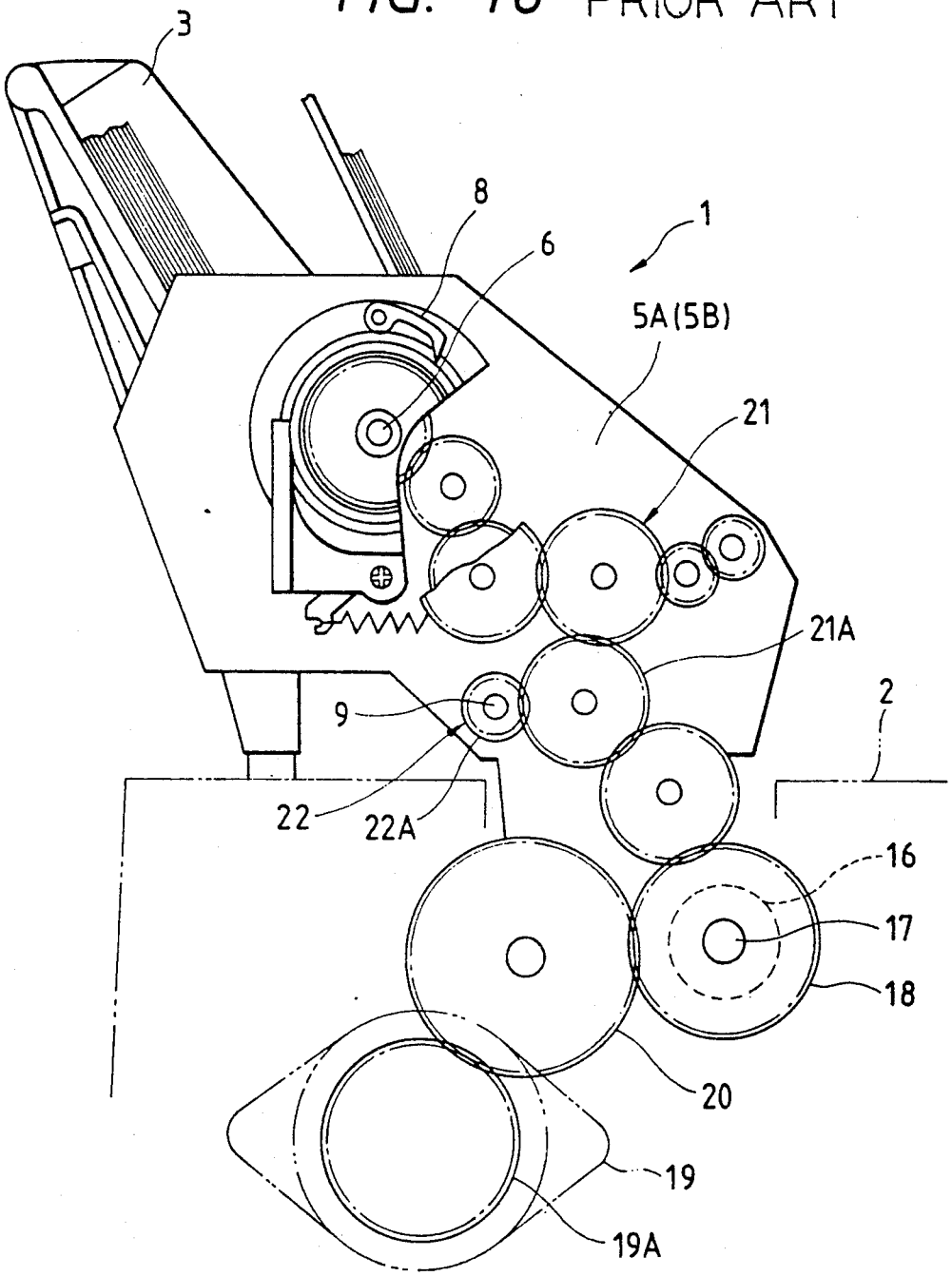
FIG. 18 PRIOR ART
FIG. 18 is a side view of the conventional feeder.
Figure 19:
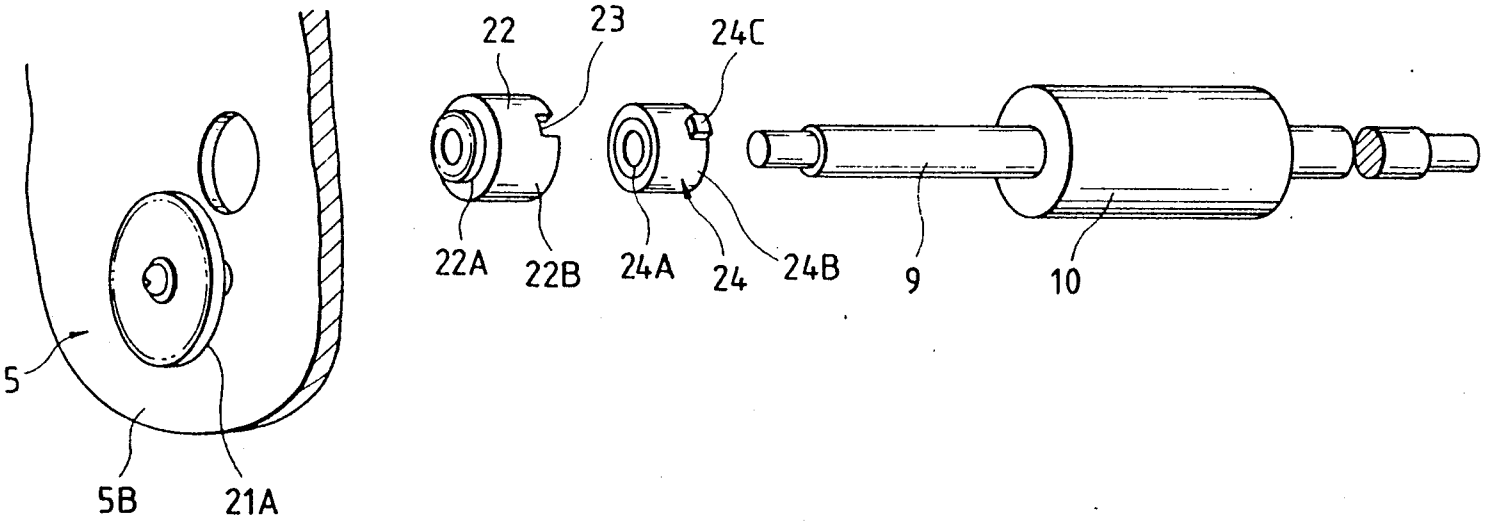
FIG. 19 PRIOR ART
FIG. 19 is a view to illustrate the transmission of torque to the second paper feed roller shaft of the conventional feeder.
Figure 20:
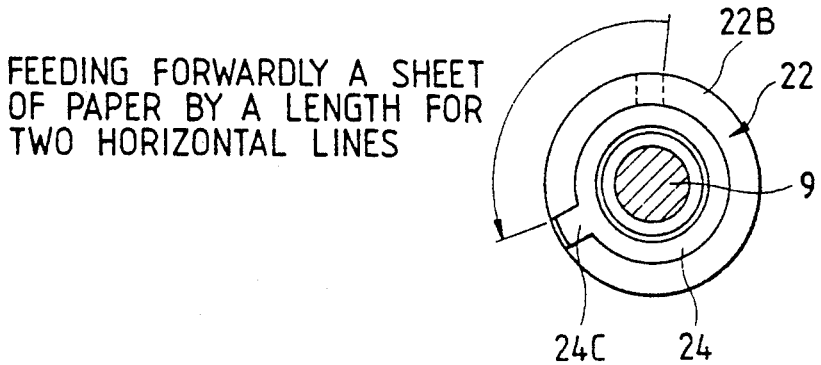
FIG. 20 PRIOR ART
FIGS. 20, 21, 22, 23 and 24 are views to illustrate the relationship between the rotation of the second paper feed roller shaft of the conventional feeder and that of the platen of a printer.
Figure 20:
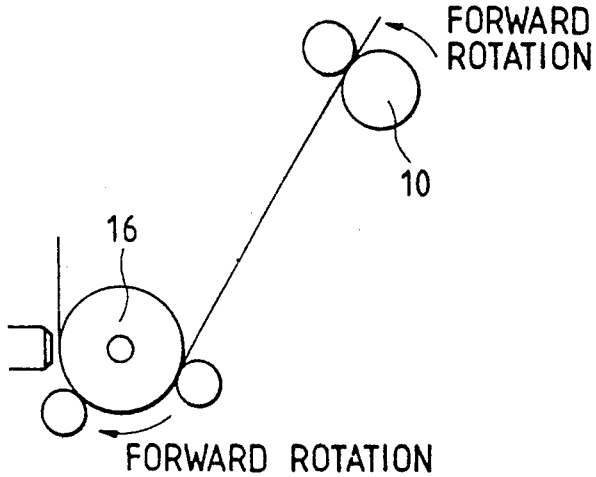
FIG. 20 PRIOR ART
Figure 21:
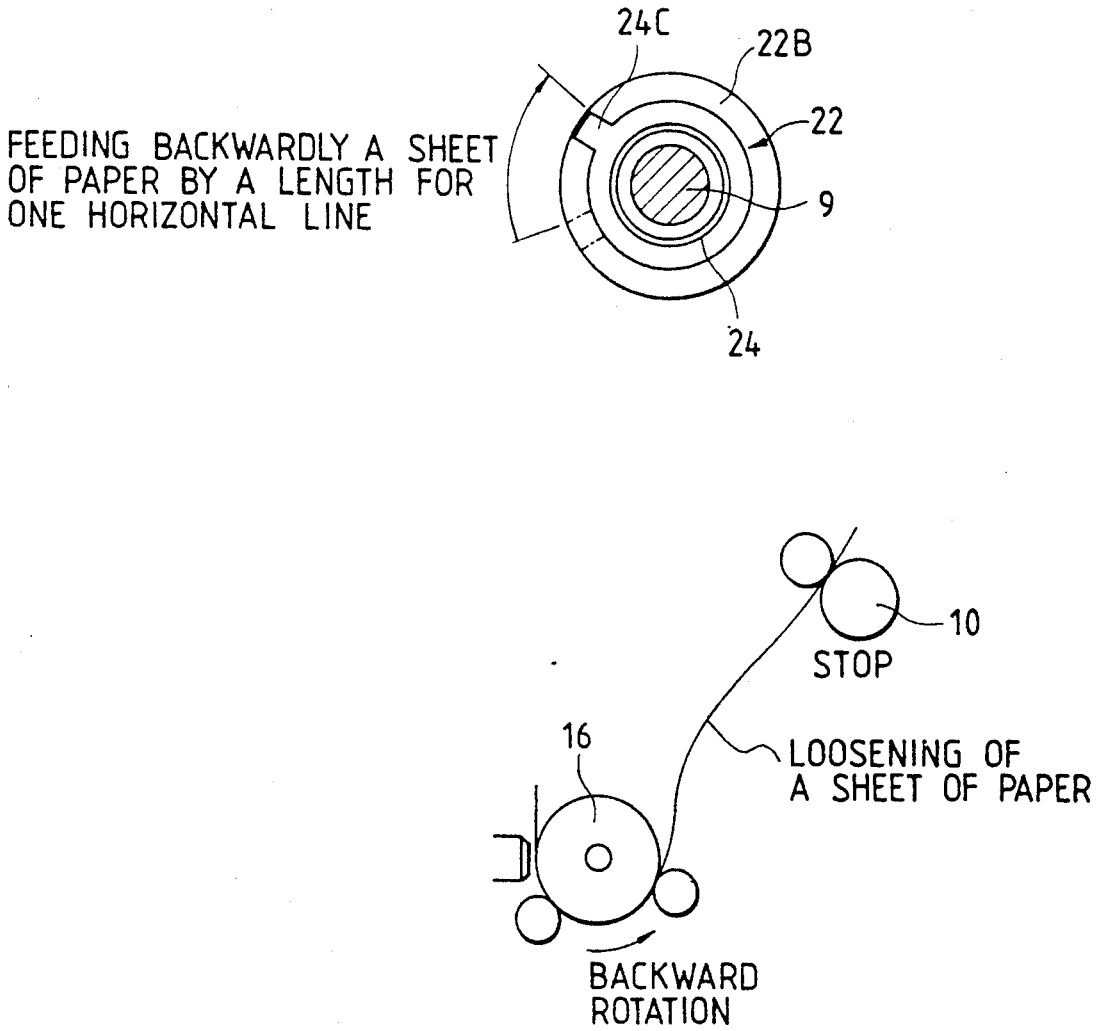
FIG. 21 PRIOR ART
Figure 22:
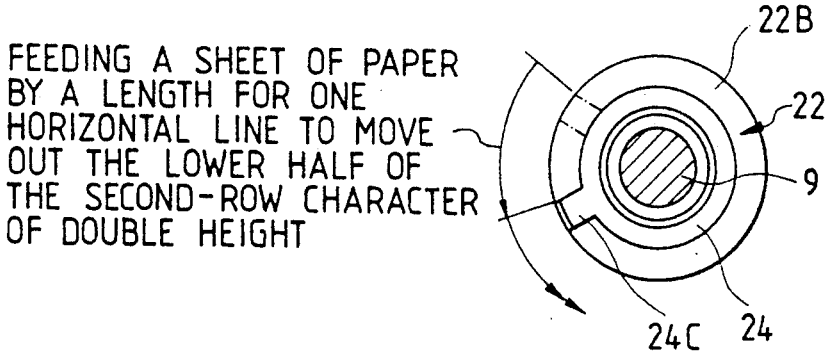
FIG. 22 PRIOR ART
Figure 22:
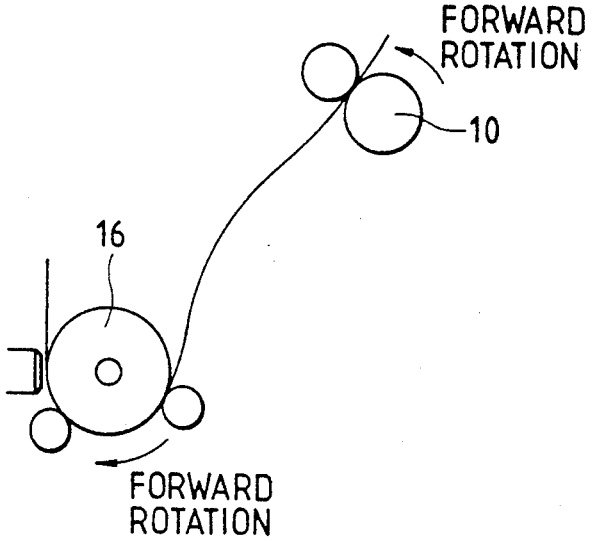
FIG. 22 PRIOR ART
Figure 23:
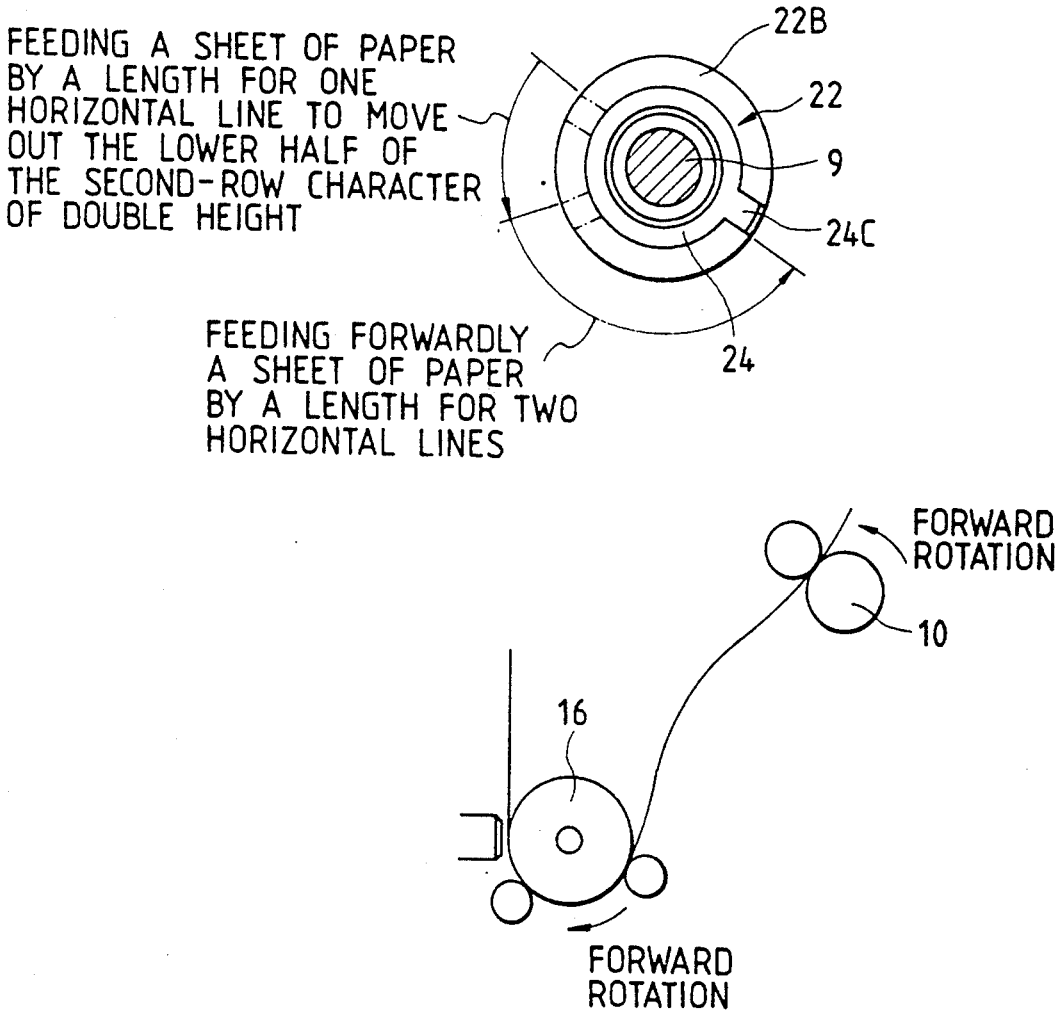
FIG. 23 PRIOR ART
Figure 24:
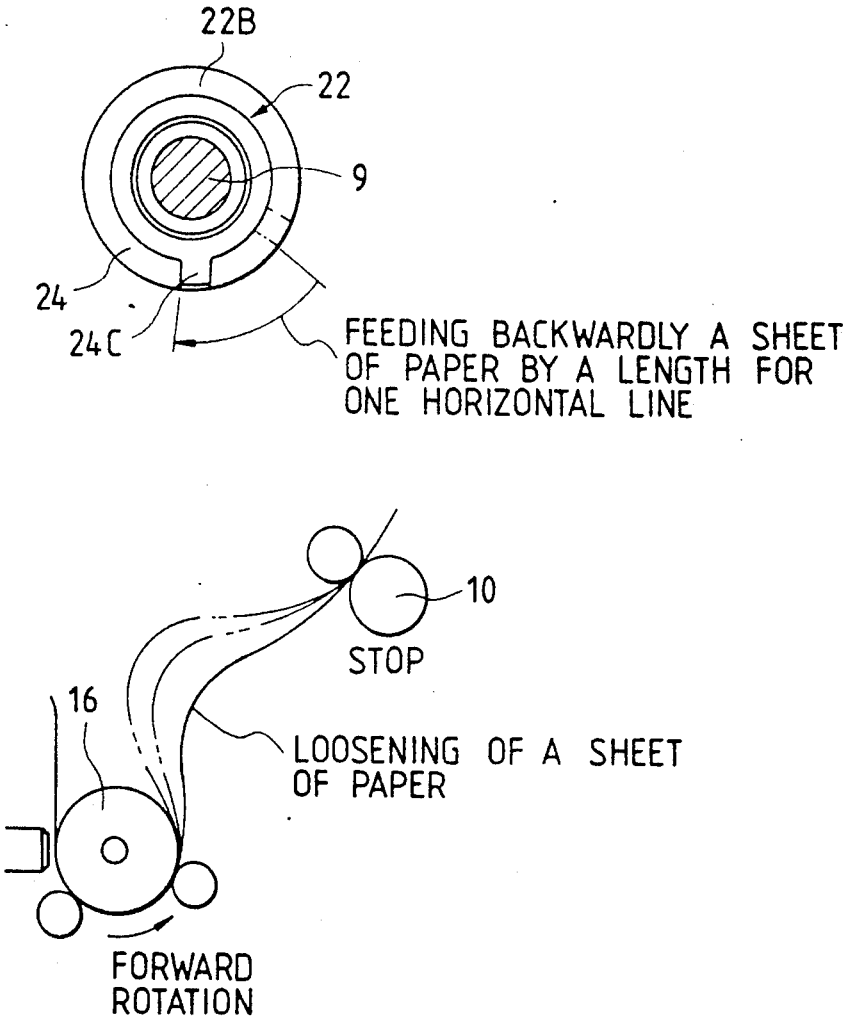
FIG. 24 PRIOR ART

Although the one-way bearings 24, 42 and 52 are provided as one-way torque transmission means in the embodiments described above, the present invention is not confined thereto but may be otherwise embodied as an automatic paper feeder as described from now on. The difference of the feeder from that shown in FIGS. 1 through 9 is described in the main with reference to FIGS. 14 and 15. The mutually equivalent portions of the feeders are denoted by the same reference symbols herein. A gear 61 is movably fitted on a second paper feed roller shaft 9 at the end thereof, at which the shaft is supported by one side plate 5B of the body frame of the feeder. The gear 61 is engaged with an idle gear 21A. A spring clutch 62 is provided between the gear 61 and the side plate 5B. When the gear 61 is rotated forward as shown by an arrow in FIG. 15, it pushes the arm 62A of the spring clutch 62 by the edge 61A of the gear at the notch thereof to turn the arm to kinematically connect the second paper feed roller shaft 9 and the clutch to each other to rotate the shaft. When the gear 61 is rotated backward, the spring clutch 62 is not rotated until the edge 61B of the gear 61 at the notch thereof comes into contact with the arm 62A of the clutch. When the gear 61 is then rotated backward further, it pushes the arm 62A of the clutch 62 by the edge 61B of the gear at the notch thereof to turn the arm but the second paper feed roller shaft 9 is not rotated because it is kinematically disconnected from the clutch. The feeder thus produces the same effect as that shown in FIGS. 1 through 9.

Although the second paper feed roller 10, which is a conveyance roller, is provided between the first paper feed roller of the feeder and the platen of the printer in each of the embodiments described above, another conveyance roller may be provided between the first paper feed roller and the platen. In that case, a clutch made of the bushing gear unit and the one-way bearing is disposed on the shaft of the conveyance roller nearest to the platen.

The present invention is not confined to the above-described embodiments and modification, but may be embodied or practiced in other various ways without departing from the scope or spirit of the invention.

What is claimed is:

1. An automatic paper feeder for feeding a sheet of paper from a paper supply bin to a platen of a printer, comprising:

a paper feed roller by which an outermost one of the sheets of paper stacked in the paper supply bin is fed toward the platen while being separated from the rest of sheets of paper;

at least one conveyance roller provided between the platen and said paper feed roller, said conveyance roller receiving a forward turning power from a drive shaft of the printer through a drive gear train having a gear unit; and a one-way torque transmission means provided between said gear unit and a shaft of said conveyance roller nearest to the platen, for transmitting the forward turning power from said gear unit to said conveyance roller shaft only when said drive shaft of the printer is rotated in the forward direction, wherein a lost motion means is provided to said gear unit and said one-way torque means for preventing the forward turning power of the drive shaft from transmitting to said conveyance roller shaft until said gear unit is forwardly rotated in a predetermined angle, after transmitting the forward turning power from said drive shaft to said conveyance roller shaft and then transmitting a backward turning power from said drive shaft to said gear unit so that said gear unit is backwardly rotated in the predetermined angle.

2. An automatic paper feeder according to claim 1, wherein said one-way torque transmission means comprises a one-way bearing.

3. An automatic paper feeder according to claim 2, wherein said lost motion means comprises:

a notch portion provided to said gear unit, said notch portion extending with a prescribed central angle; and a protruded portion provided to an outer surface of said one-way bearing to move in said notch.

4. An automatic paper feeder according to claim 3, wherein a length of said notch portion is shorter than a total circumference of said gear unit.

5. An automatic paper feeder according to claim 2, wherein said lost motion means comprises:

a protruded member provided to said gear unit; and a notch portion provided to an outer surface of said one-way bearing, wherein said protruded member is located in said notch portion.

6. An automatic paper feeder according to claim 2, wherein said lost motion means comprises:

a pair of pins provided to said gear unit; and a protruded portion provided to an outer surface of said one-way bearing, said protruded portion moving back and forth between said pins.

7. An automatic paper feeder according to claim 6, wherein a plurality of holes are provided to said gear unit at predetermined intervals in the circumferential direction of said gear unit so that said pins are provided in selected ones of said holes to alter a space between said pins.

8. An automatic paper feeder according to claim 2, further comprising a side plate which rotatably supports said conveyance roller shaft, wherein said gear unit has a notch, and said one-way torque transmission means comprises:

a spring clutch provided between said gear unit and said side plate for transmitting the forward turning power to said conveyance roller shaft only when said gear unit is rotated in the forward direction.

* * * * *